United States Patent [19]

Chen

[11] Patent Number: 5,070,927

[45] Date of Patent: Dec. 10, 1991

[54] ROLLER ASSEMBLY FOR A WINDOW BLIND

[76] Inventor: Cheng-Hsiung Chen, No. 228, Sec. 2, Chung-Te Rd., Pei-Tun Dist., Taichung City, Taiwan

[21] Appl. No.: 722,188

[22] Filed: Jun. 27, 1991

[51] Int. Cl.[5] ..... A47H 5/00

[52] U.S. Cl. ..... 160/344; 160/171

[58] Field of Search ..... 160/171, 344, 178.1, 160/341, 124, 345

[56] References Cited

U.S. PATENT DOCUMENTS 3,352,349 11/1967 Hennequin ..... 160/171

FOREIGN PATENT DOCUMENTS 1286899 1/1962 France ..... 160/171

955,899 4/1964 United Kingdom ..... 160/171

*Primary Examiner*—Blair M. Johnson

*Attorney, Agent, or Firm*—Ladas & Parry

[57] ABSTRACT

A roller assembly includes an elongated casing with a shaft longitudinally provided within it. A U-shaped bracket with two opposed sides and a bottom connecting the two sides is fixed in the elongated casing. A threaded rod is sleeved on the shaft in such a way that it can rotate along with the shaft. A guiding block having a first face, a second face and an internally threaded through-hole is sleeved on the threaded rod. Each of the face have a guiding wheel. The block is sized and designed so as to sit flush on the U-shaped bracket and prevent the bracket from rotating with the threaded rod, but allowing instead the block to move axially along on the threaded rod. One end of a first string connects to one end of the threaded rod and winds on the same to a position adjacent to the first face whereat the first string is held straight between the guiding wheel on the first face and the threaded rod. A second string is also held straight between the guiding wheel on the second face of the block and the threaded rod in the same manner.

1 Claim, 6 Drawing Sheets

ROLLER ASSEMBLY FOR A WINDOW BLIND

BACKGROUND OF THE INVENTION

1. Field of the Invention

This invention relates to a roller assembly, more particularly to a roller assembly to be incorporated with a Venetian blind and/or curtain.

2. Description of the Related Art

Referring to FIGS. 1 and 2, a prior art roller assembly used in conjunction with a Venetian blind or a curtain, is shown to comprise an elongated hollow casing (10) having a driving means, (not shown in Figures) provided therein, a shaft (20) longitudinally provided in said elongated hollow casing (10) and connected to and driven by said driving means to rotates on its axis. The driving means is generally a motor or any other rotatable apparatus, such as a beaded chain. One end of each of a plurality of strings (B) is connected to a blind/curtain in a conventional way and the other end is connected to the shaft (20). When the shaft rotates, the strings are wound or unwound on the shaft, thereby opening or closing the blind/curtain.

During the roll up procedure, the strings are occasionally wound onto the shaft in an overlapping manner, tangling the strings as illustrated in FIG. 2, because there is no guiding means to ensure that the strings are wound evenly and regularly on the shaft. Since most of the blinds/curtains have more than one string, and since, the overlapping occurs often, the various strings (B) will wind and unwind at different rates, resulting in the blind/curtain being left in an uneven position. This is unattractive and frustrating for the users.

SUMMARY OF THE INVENTION

The main object of the present invention is to provide a roller assembly to be used in conjunction with a blind/curtain so that said roller assembly can wind or unwind the strings of the blinds/curtains evenly and regularly in such a manner that the various strings will not overlap as often as the case with the previous art.

Accordingly, the roller assembly of the present invention includes a shaft longitudinally provided in an elongated hollow casing. The shaft is connected to a driving means and is driven by the same. A substantially U-shaped frame that includes two opposed sides and a bottom connecting the two opposed sides is fixed in the elongated hollow casing. A threaded rod is journalled between the two opposed sides of the U-shaped frame with the shaft passing through the threaded rod in such a manner that the threaded rod can rotate along with the shaft. A block with a first face, a second face opposite to the first face and an internally threaded hole is sleeved on the threaded rod with two ends of the threaded rod extending through the block. Each face of the block has a guiding device. The block is sized and designed in such a way that it can not rotate with the threaded rod but is capable of moving along the threaded rod, when the threaded rod is rotated by the shaft. A first string has a first end attached to one end of the threaded rod. The first string is wound on the threaded rod to a position adjacent to the first face of the block and is held threaded through the guiding device so that it runs straight between the guiding device and the threaded rod. A second string has a first end attached to the other end of the threaded rod and is wrapped around the threaded rod to a position adjacent to the second face of the block. A bobbin disposed in the elongated hollow casing on the opposite end of the casing away from the driving means provides the point of connection for the second ends of the first and second strings. The block moves axially along the threaded rod when the latter is rotated by the shaft.

BRIEF DESCRIPTION OF THE DRAWINGS

Other features and advantages of the present invention will become more apparent in the following detailed description, including drawings, all of which show non-limiting, forms of the invention, and of which.

DETAILED DESCRIPTION OF THE PREFERRED

Figure 1:
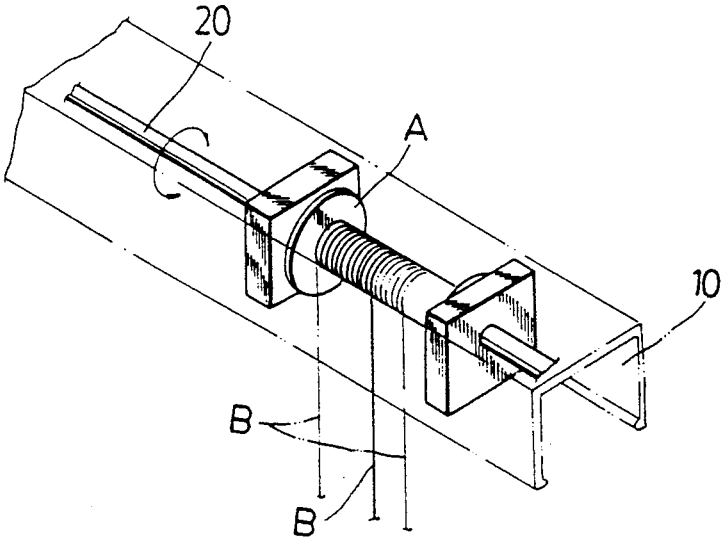
FIG. 1 PRIOR ART
FIGS. 1 and 2 respectively show a conventional roller assembly.
Figure 2:
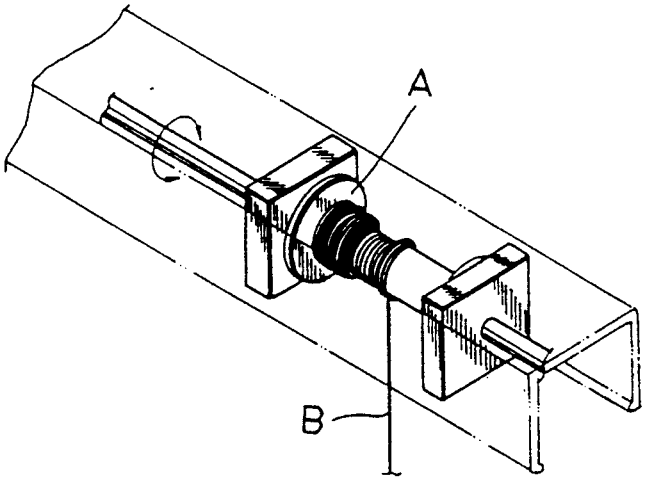
FIG. 2 PRIOR ART
Figure 3:
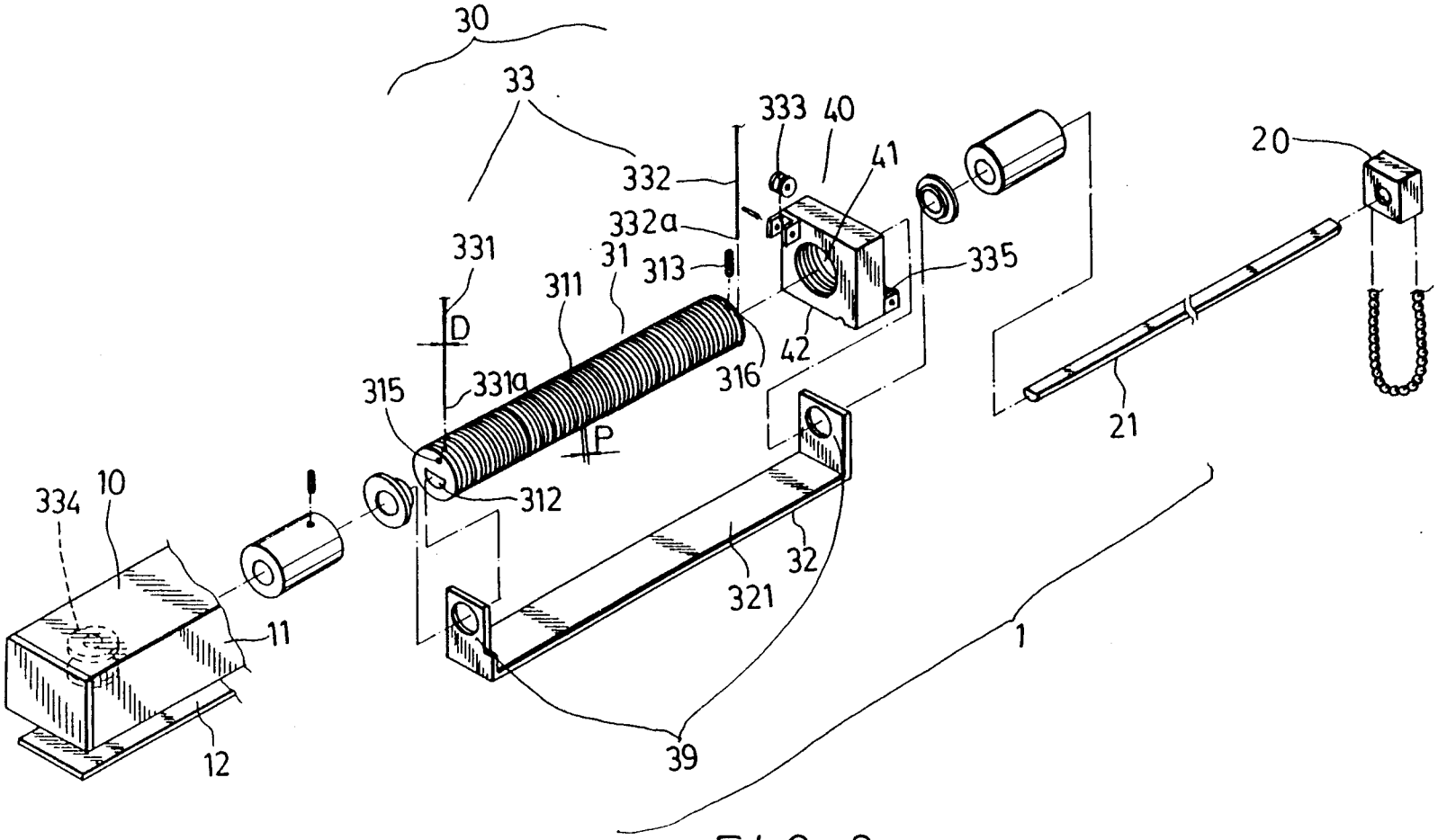
FIG. 3 is an exploded view of a roller assembly of the present invention shown without a blind attached thereto.

Referring to FIG. 3, a roller assembly (1) of the present invention is shown to comprise generally an elongated rectangular hollow casing (10), a driving means (20), a rotatable shaft (30), a guiding device (40) and a curtain/blind (50).

The driving means (20) can be a motor or a beaded chain or any other conventional method so as to effect rotation of a shaft (21). The shaft (21) is longitudinally provided in the rectangular casing (10) and is connected to the beaded chain so that the shaft can rotate on its axis when the chain is pulled.

A substantially U-shaped bracket (32) has two opposed sides (39) and a bottom (321) connecting the two opposed sides (39). The U-shaped bracket (32) is fixed in the casing .(10). A threaded rod (31) is journalled between the U-shaped bracket with the shaft (21) passing through the threaded rod (31). They are arranged in a known manner that the threaded rod (31) can rotate with the shaft (21).

A block (40) has a first face, a second face opposite the first face and an internally threaded through-hole (41). Each face has a guiding wheel (333,335). The block (40) also has a base (42) which is in contact with the bottom (321) of the U-shaped bracket (32) when the block threadedly engages the threaded rod (31). Thus by having the base (42) of the block (40) sitting flush on the U-shaped bracket (32), the block (40) is prevented from rotating when the threaded rod (31) rotates. Instead, the block (40) moves along the threaded rod as the threaded rod (31) rotates.

A first string (331) has a first end (331*a*), fixed in a hole (315) at one end of the threaded rod (31) and then wrapped around the same to a position adjacent to first face of the block (40) whereat the first string is held straight between the guiding wheel (333) of the block (40) and the threaded rod (31). Similarly, a second string (332) that includes a first end (332*a*) fixed in a hole (316) at the other end of the threaded rod (31) is wound around the same to a position adjacent to the second face of the block (40), whereat the second string (332) is held straight between the guiding wheel (335) and the threaded wheel (31), as illustrated in FIG. 4.

Figure 4:
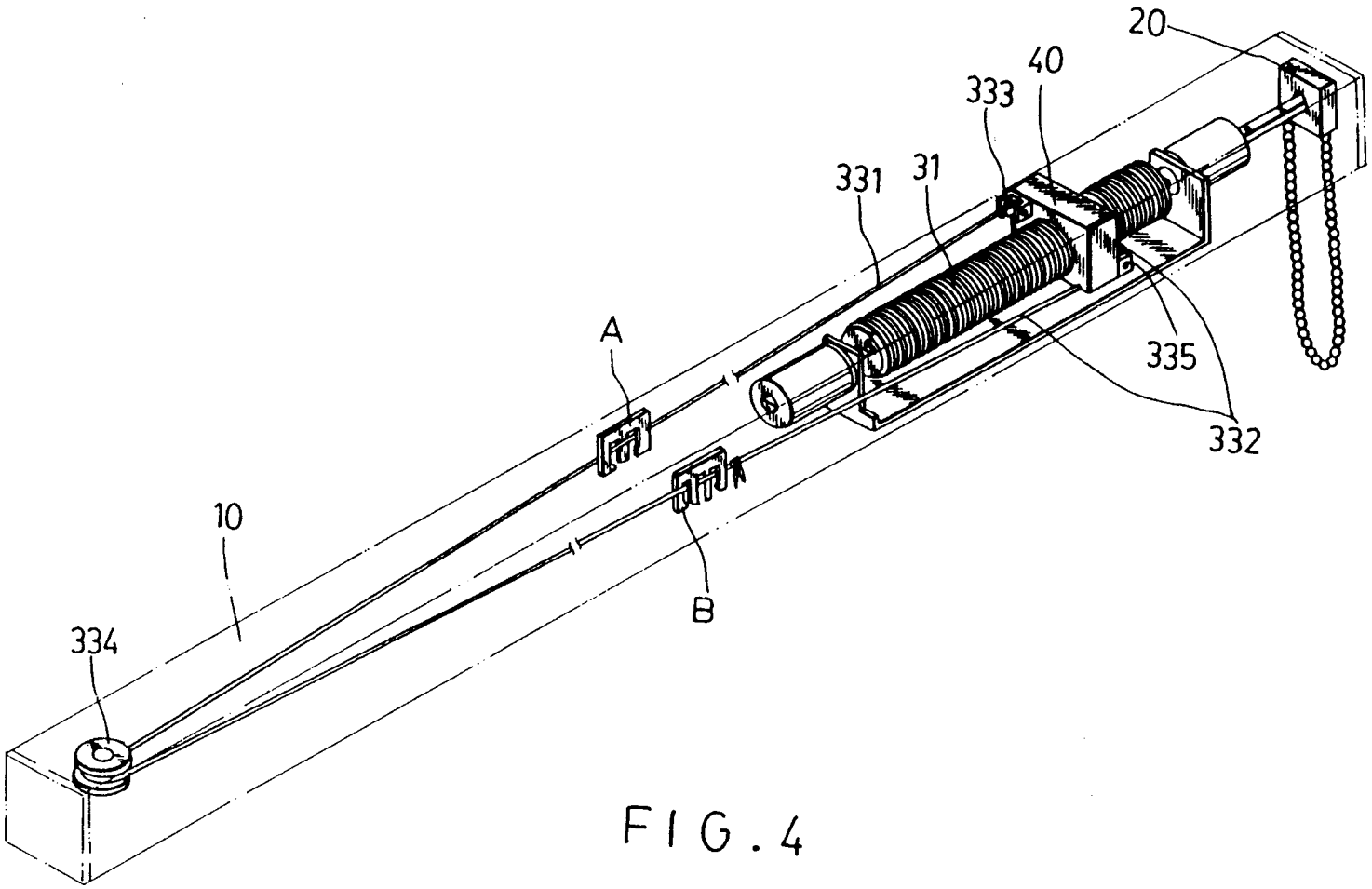
FIG. 4 is the roller assembly of FIG. 3 shown without a blind attached thereto.
Figure 5:
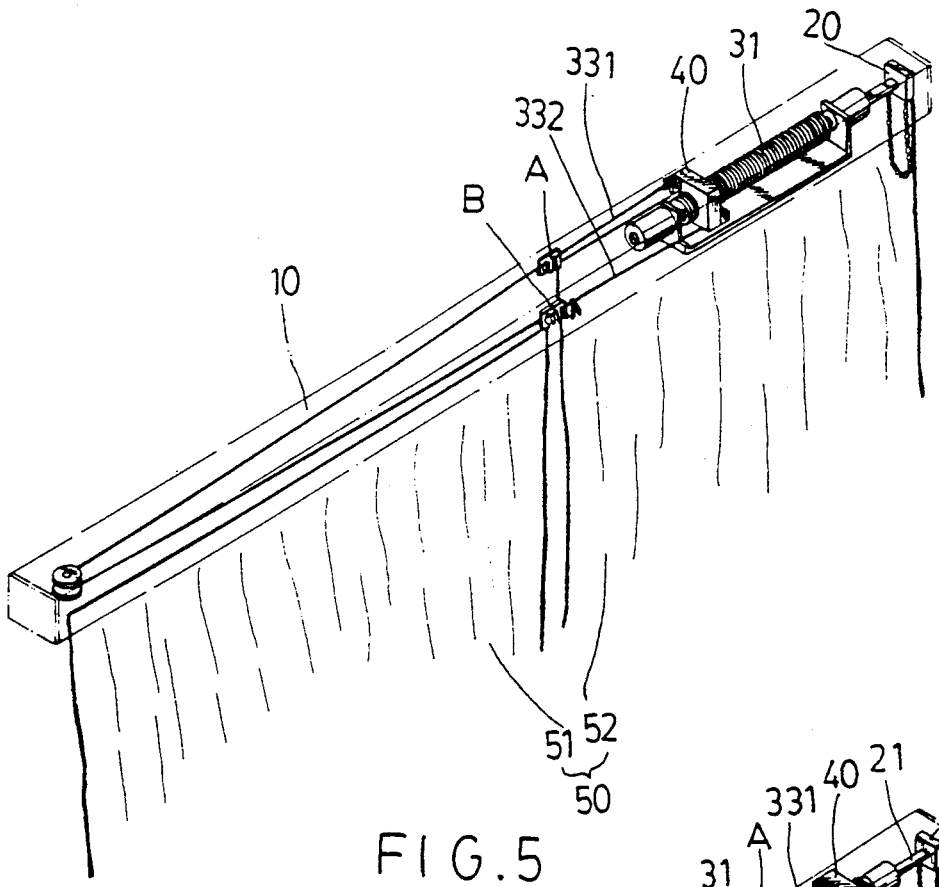
FIG. 5 shows the roller assembly of FIG. 4 with a curtain attached thereto.

Referring to FIG. 4, a bobbin (334) is disposed at a corner of the elongated casing (10). The free end of the first string (331) encircles the bobbin to connect with the free end of the second string (332). A curtain (50) can be attached to the strings (331,332) by a known method as illustrated FIG. 5. So that the two parts of the curtain (51,52) is held in a proper position and a pair of holding plates (A,B) is fixed along the strings as also shown in FIG. 5. Since the connecting relationship of the curtain to the strings is not related to the present invention, a detailed explanation of such, therefore, will be omitted herein.

To action the above-described roller assembly, the beaded chain (20 is pulled thereby moving the shaft (21) which in turn drives the threaded rod (31) to rotate. Since the threaded rod (31) is journalled between the U-shaped bracket (32), it will rotate on its own axis, and at the same time the block (40) moves along on the threaded rod (31). Because the block (40) is sized and designed in such a manner that the bottom of the block (40) is flush with the bracket (32), the block (40) does not rotate, but can only move along the threaded rod (31).

Figure 6:
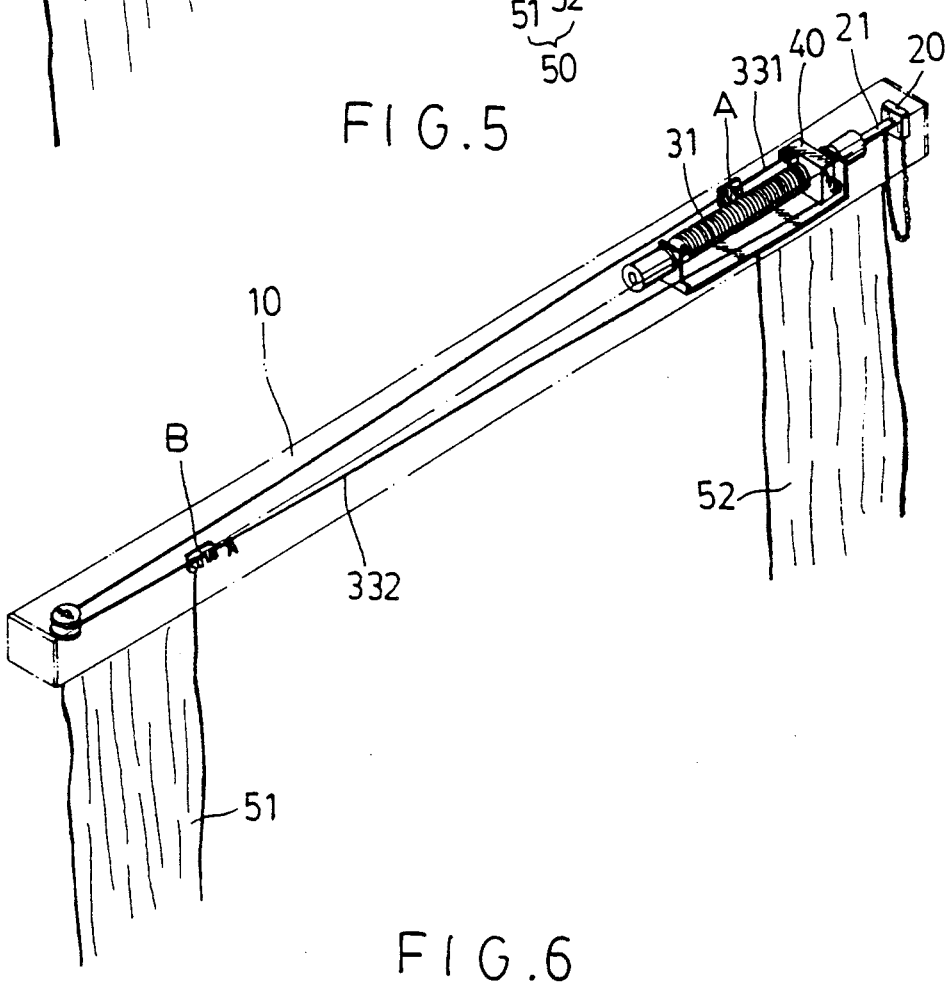
FIG. 6 shows the roller assembly of FIG. 5 with a curtain attached thereto, the curtain being drawn apart.
Figure 7:
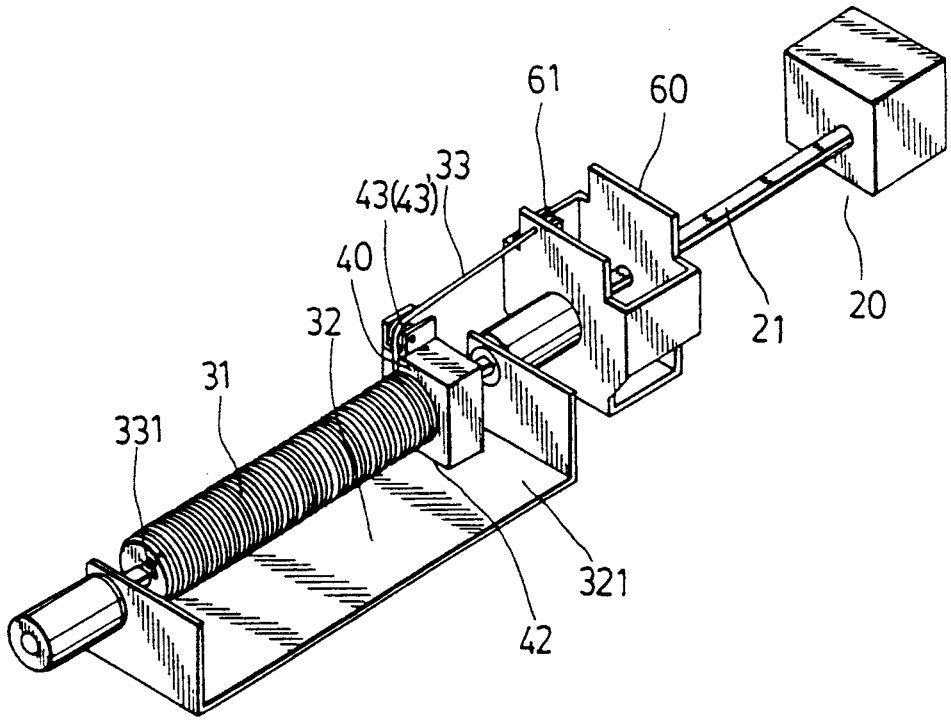
FIG. 7 shows another preferred embodiment of a roller assembly of the present invention, without a blind attached thereto.

The movement of the block (40) along the threaded rod in one direction or another direction opposite of said direction closes or opens the curtain, as shown in FIGS. 5 and 6. During rolling operation, the strings are guided evenly and regularly by the guiding wheels (333,335) attached to the block (40). It is important to note that the string (D) used in this preferred embodiment must not be wider than the pitch (P) of the threaded rod (31). Otherwise the string may jam in the threaded through-hole (41) of the block (40).

Figure 8:
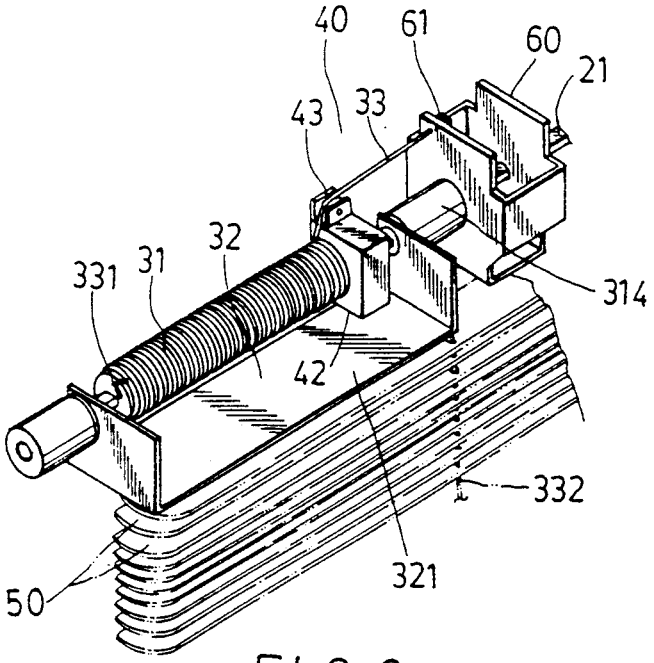
FIG. 8 shows the roller assembly of FIG. 7 with a Venetian blind attached, the blind being in a rolled up position.
Figure 9:
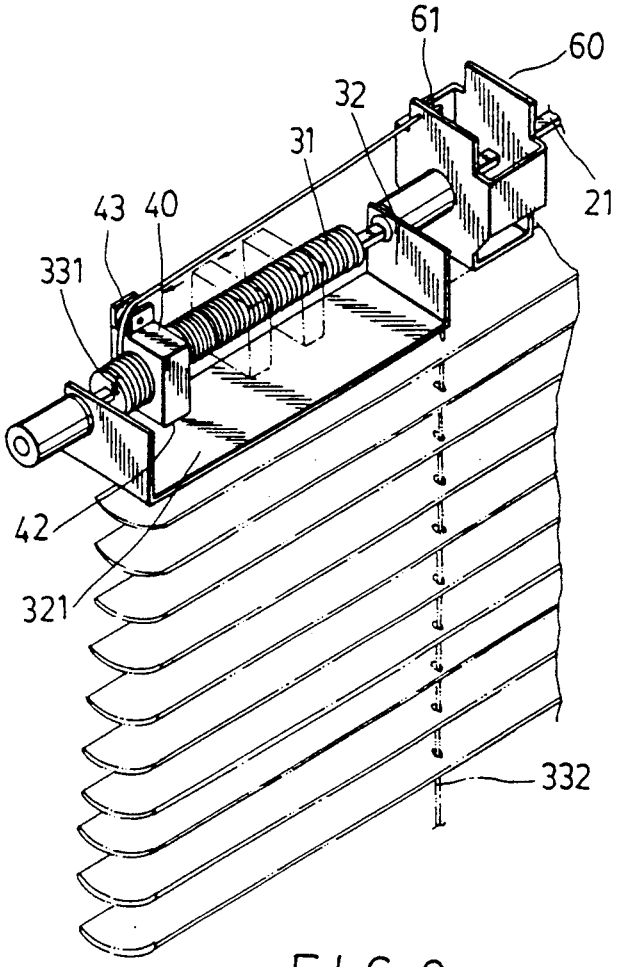
FIG. 9 shows the roller assembly of FIG. 8 with a Venetian blind attached, the blind being unrolled from the assembly.

If the roller assembly of the present invention is used with a Venetian blind (50), the free end of the first and second strings (331,332) are held vertically downward as shown in FIGS. 8 and 9. In order to accomplish this configuration, the strings are threaded through a fixing plate (60) and around the guiding wheels (61) which lead the strings vertically with respect to the shaft (21). The fixing plate (60) with attached guiding wheels (61) is fixed in the hollow casing. The opening and closing operations of the Venetian blind are otherwise same as explained above. Therefore the Venetian blinds (50) can be raised or lowered when the block (40) moves on the threaded rod (31).

With the invention thus explained, it is obvious to those skilled in the art that various modifications and variations can be made without departing from the scope and spirit of the present invention. It is therefore intended that this invention be treated only as in the appended claims.

I claim:

1. A roller assembly for a window blind, comprising:

an elongated hollow casing having a length substantially equal to the width of a window frame to be mounted thereto;

a driving means provided in said elongated hollow casing;

a shaft longitudinally provided in said elongated hollow casing and connected to said driving means, said shaft being driven by said driving means to rotate on its axis;

a substantially U-shaped frame including two opposed sides and a bottom connecting said two opposed sides, said U-shaped frame being fixed in said elongated hollow casing;

a threaded rod being journalled between said two opposed sides of said U-shaped frame with said shaft being sleeved through said threaded rod, said threaded rod being rotated by said shaft;

a block having a first face and a second face opposite to said first face, a base portion and an internally threaded through-hole, each of said faces having a guiding device, said block being sleeved on said threaded rod with two ends of the same extending through said block and said base portion of said block being in contact with said bottom of said U-shaped frame, said bottom of said U-shaped frame preventing said block from rotating with said threaded rod but permitting said block to move axially on said threaded rod when said threaded rod is rotated by said shaft;

a first string that includes a first end distal from said first face of said block and connected to one end of said threaded rod, a part of said first string being wrapped around said threaded rod to a position adjacent to said first face of said block so that said first string is held straight between said threaded rod and said guiding device of said first face of said block;

a second string includes a first end distal from said second face of said block and connected to the other end of said threaded rod, a part of said second string being wrapped around said threaded rod to a position adjacent to said second face of said block so that said second string is guided straight between said threaded rod and said guiding device of said second face of said block; and means for connecting the second end of said first string to the second end of said second string, said means being provided in said elongated hollow casing away from said driving means;

whereby when said shaft is driven to rotate in a first rotary direction, said block moves axially along said threaded rod in a first lateral direction, and when said shaft is driven to rotate in a second rotary direction opposite to said first rotary direction said block moves axially along said threaded rod in a second lateral direction opposite to said first lateral direction.

* * * * *